US005405080A

United States Patent [19]

Yeung et al.

[11] Patent Number: 5,405,080

[45] Date of Patent: Apr. 11, 1995

[54] TOY TRACK COUPLING MECHANISM

[75] Inventors: K. Y. Yeung; Edmond Cheung, both of Sha Tin, Hong Kong

[73] Assignee: Marchon, Inc., Vernon Hills, Ill.

[21] Appl. No.: 962,411

[22] Filed: Oct. 16, 1992

[51] Int. Cl.[6] ..... A63H 18/08; A63H 18/12

[52] U.S. Cl. ..... 238/10 F; 446/121; 446/446

[58] Field of Search ..... 238/10A, 10B, 10C, 10E, 238/10F; 191/22 C; 104/DIG. 1; 273/86 R, 86 B; 446/444, 446, 120, 121

[56] References Cited

U.S. PATENT DOCUMENTS

| | | | |
|---|---|---|---|
| 3,206,122 | 9/1965 | Frisbie et al. | 273/86 |
| 3,243,120 | 3/1966 | Lingard et al. | 191/22 C |
| 3,476,389 | 11/1969 | Hok-Shou | 273/86 |
| 3,510,631 | 5/1970 | Weinberg et al. | 273/86 |
| 3,712,615 | 1/1973 | Staats et al. | 273/86 |
| 4,082,220 | 4/1978 | Cheng et al. | 238/10 |
| 4,091,995 | 5/1978 | Barlow et al. | 238/10 |
| 4,195,776 | 4/1980 | Lehmann | 238/10 C X |
| 4,372,489 | 2/1983 | Lee | 238/10 F |
| 4,382,599 | 5/1983 | Tilbor | 446/444 X |
| 4,697,812 | 10/1987 | Rudell et al. | 238/10 F X |
| 4,838,828 | 6/1989 | Ohnuma et al. | 446/446 |
| 4,953,785 | 9/1990 | Keska | 238/10 A |
| 4,997,187 | 3/1991 | Smollar et al. | 273/86 |

FOREIGN PATENT DOCUMENTS

| | | | |
|---|---|---|---|
| 2443858 | 8/1980 | France | 238/10 |
| 3003846 | 8/1981 | Germany | 238/10 E |
| 984746 | 3/1965 | United Kingdom | 238/10 F |
| 2063086 | 6/1981 | United Kingdom | 238/10 F |

*Primary Examiner*—Michael S. Huppert
*Assistant Examiner*—Scott L. Lowe
*Attorney, Agent, or Firm*—Laff, Whitesel, Conte & Saret, Ltd.

[57] ABSTRACT

An toy track coupling mechanism has guidance channels to aid alignment formed on confronting ends of the track sections. A horizontally operating latch prevents unwanted disconnection of the coupled track sections during assembly and play. A laterally adjacent horizontally operating release switch allows easy disassembly of the track sections by disengaging the latch in response to natural hand pressures and movements.

6 Claims, 3 Drawing Sheets

TOY TRACK COUPLING MECHANISM

FIELD OF THE INVENTION

This invention relates to coupling mechanisms for toy tracks and, more particularly, to reversible coupling mechanisms for toy track sections.

BACKGROUND OF THE INVENTION

Many toys such as road race or train sets require assembly prior to use. Such toy parts must fit together properly and hold together securely while in use. Afterwards, rapid disassembly of the toy is desirable so that the toy parts may be stored away quickly and conveniently.

Toy track games such as road race sets typically include interconnecting track sections. When electrically driven toy vehicles are operated on such tracks, precise electrical as well as mechanical coupling of adjacent track sections is required for continuous operation and play. Also, the coupled track sections must be resistant to the disruptive vertical, horizontal and torsional forces that occur during setup and operation. Yet, the track sections must be capable of simple, quick and effective assembly and disassembly by children.

Prior toy track coupling mechanisms include track sections that engage either by sliding sideways or by inserting longitudinally into each other. However, these coupling mechanisms often do not effectively resist the horizontal and vertical stresses that frequently occur during assembly of the track sections and subsequent operation.

One toy track coupling mechanism, as set out in U.S. Pat. No. 4,997,187, incorporates an integral lock and release mechanism responsive to vertical pressure on its surface. This design, however, appears restricted to use with double lane track configurations, and its release sequence invites permanent deformation of the track surface through continued use. Also, the release sequence of this mechanism may be difficult for a child to master when grasping the track for disassembly, because it requires downward pressure on two separate points at the center of the track surface with simultaneous grasping of the edges of the track sections to pull them apart.

Accordingly, it is one object of this invention is to provide a simple yet effective coupling mechanism for toy track sets.

Another object of this invention is to provide a reversible coupling mechanism for toy track sets that is resistant to the vertical, horizontal and torsional forces that frequently occur during assembly and play.

A further object of this invention is to provide a coupling mechanism that easily engages and disengages the track sections in response to natural hand pressures and movements that will not deform the track surface through continued use.

A still further object of this invention is to provide an effective coupling mechanism for use on single lane tracks.

Further objects will become apparent from the following description, drawings and claims.

BRIEF SUMMARY OF THE INVENTION

The present invention provides a reversible coupling mechanism that easily and securely joins toy track sections to meet the above objectives. The coupling mechanism comprises a unique guidance channel for aligning the track sections during mating and a latch mechanism that operates horizontally to the plane of the track surface for securely holding the sections together after they are joined. Laterally associated with each latch mechanism is a horizontally operating separate release mechanism for disengaging the latch prior to separating the track sections during disassembly.

In one important embodiment, the invention comprises confronting track sections wherein a projecting pin and a receiving socket mate with each other, thereby aligning the track sections as they are joined together. A horizontally movable, resilient hook and a confronting keeper are positioned laterally adjacent to the pin and socket, thereby acting to secure the track sections when joined together. A separate, laterally positioned, horizontally acting release switch disengages the hook from the keeper for disassembly of the track sections. In this way, the adjoining track sections are held together securely until the user intentionally applies the required pressure on the releasing switches before pulling them apart.

BRIEF DESCRIPTION OF THE DRAWINGS

These and other features of this invention are best understood by referring to the following detailed description of the invention, taken in conjunction with the accompanying drawings, in which.

Figure 1:
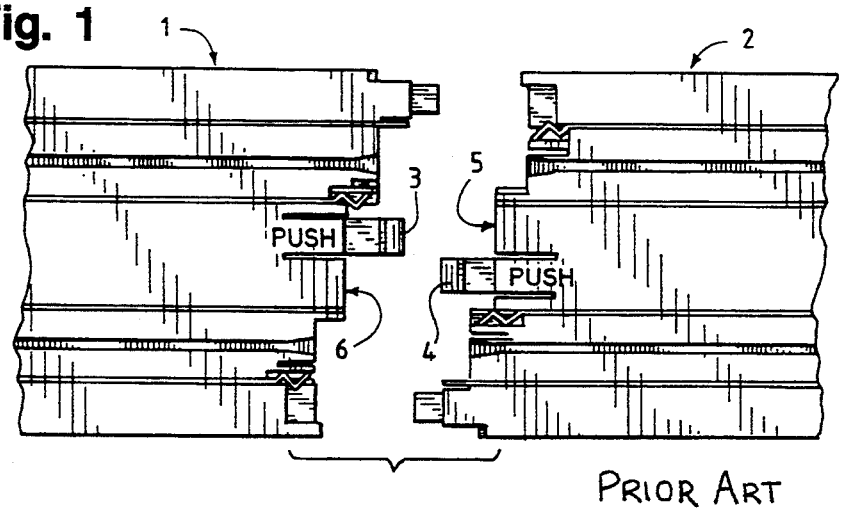
FIG. 1 is a top plan view of a previous toy vehicle slot track as set out in U.S. Pat. No. 4,997,187.
Figure 2:
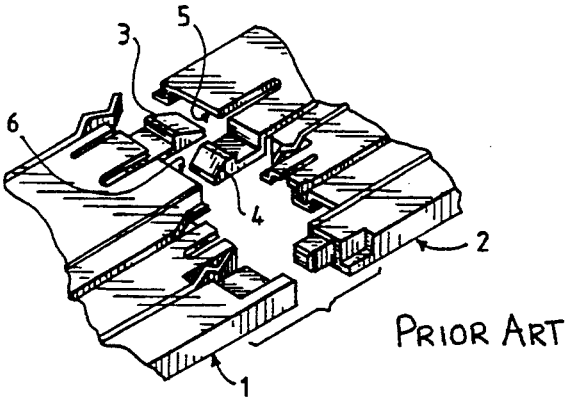
FIG. 2 is a perspective view of the previous toy vehicle slot track of FIG. 1.

DETAILED DESCRIPTION OF THE INVENTION:

Referring to FIGS. 1 and 2, there is shown a previous toy vehicle slot track as set out in U.S. Pat. No. 4,997,187. This slot track comprises opposing track sections 1, 2 that include a pair of centrally located hooks 3, 4 such that one hook projects longitudinally from each track section 1, 2 respectively. The hooks 3, 4 are vertically resilient, rather than horizontally resilient. Thus, upon insertion into the opposing track section, hooks 3 and 4 are vertically deflected before engaging and locking onto their respectively keepers 5, 6, located on the undersurface of track sections 1, 2.

To separate track sections 1, 2, a vertical force must be applied to the top of hooks 3, 4, such that the surface of the track sections 1, 2 is pushed downwardly until hooks 3, 4 are freed from their respective keepers 5, 6. Once freed, track sections 1, 2 may then be pulled apart and separated from each other.

Figure 3:
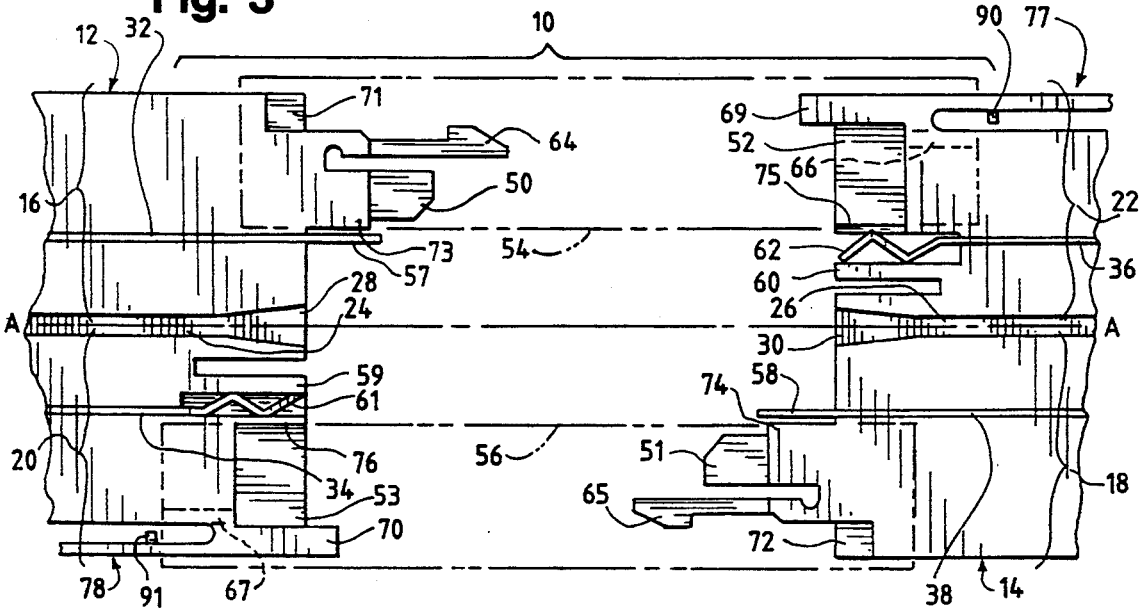
FIG. 3 is a top plan view of the inventive coupling mechanism showing the confronting ends of two track sections.

In contrast, FIG. 3 is a plan view of the present inventive track coupling mechanism 10 showing two confronting toy track sections 12 and 14. The track coupling mechanism 10 is separated into upper and lower halves by line A—A. Upper half 16 of track section 12 is identical to lower half 18 of track section 14, but rotated in space by 180 degrees. Likewise, lower half 20 of track section 12 is identical to upper half 22 of track section 14, but is also rotated 180 degrees. Therefore, if track section 12 is rotated about its vertical axis by 180 degrees and placed atop track section 14, the two track sections 12 and 14 will be seen as being identical.

Proper operation of a toy vehicle on an entire assembled toy track set requires that all track sections of a proposed layout scheme maintain effective electrical and mechanical continuity throughout. Because toy vehicle track sets are subject to horizontal, vertical and torsional forces during set-up and play, such as when a child coaxes the final track sections together to fit a particular layout, a pair of substantially improved coupling channels 54 and 56, shown outlined in FIG. 3, are included on opposite lateral ends of the track coupling mechanism 10. Each improved coupling channel 54, 56 consists of several adjacent elements that act cooperatively to provide for quick alignment and secure mechanical and electrical connections of track sections 12, 14.

Figure 4:
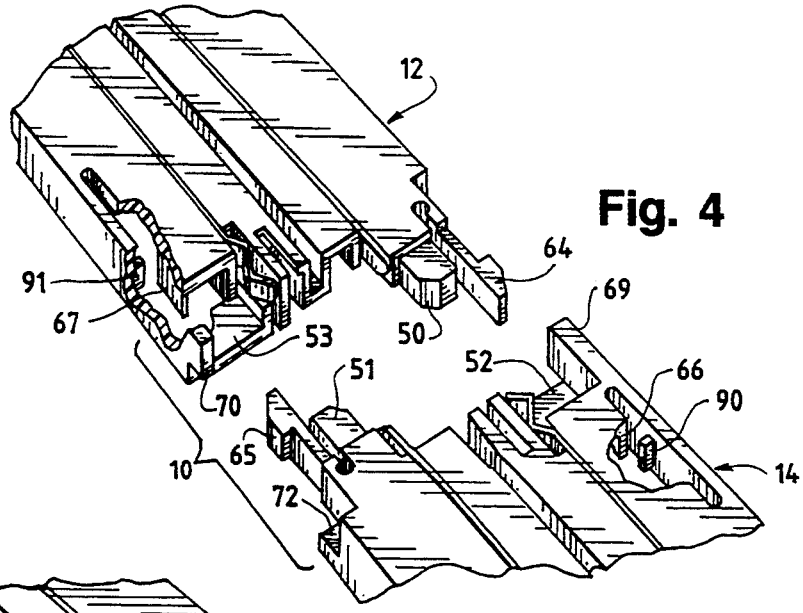
FIG. 4 is a perspective view showing the two track sections of FIG. 3.
Figure 5:
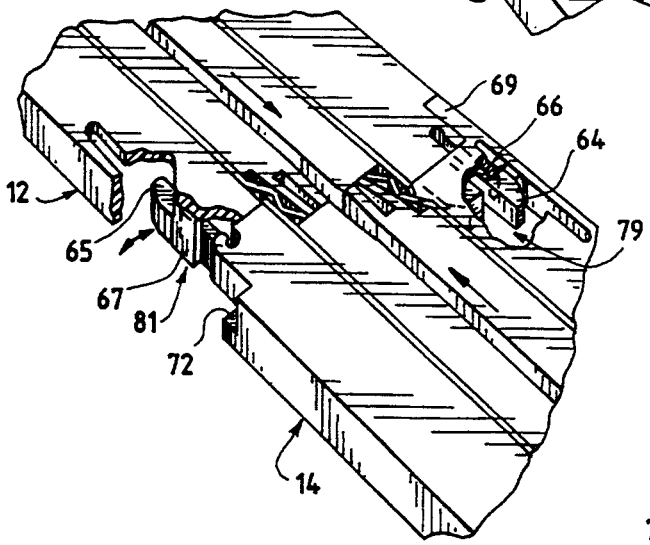
FIG. 5 is a perspective view showing the two track sections of FIGS. 3 and 4 joined together.

As shown in FIGS. 4 and 5, secure closure of track sections 12, 14 is achieved by latching mechanisms 79 and 81 as hooks 64 and 65 reach the distal ends of keepers 66 and 67. The force necessary to latch hooks 64, 65 onto keepers 66, 67 is created by the bending of hooks 64, 65 into the relatively narrow channel of receptacles 52, 53 and the pressure of projection pins 50, 51 on hooks 64, 65. Once keepers 66, 67 are encountered by hooks 64, 65, positive locking is achieved as hooks 64, 65 slip over the distal edges of keepers 66, 67, effectively holding track sections 12, 14 together.

Figure 6:
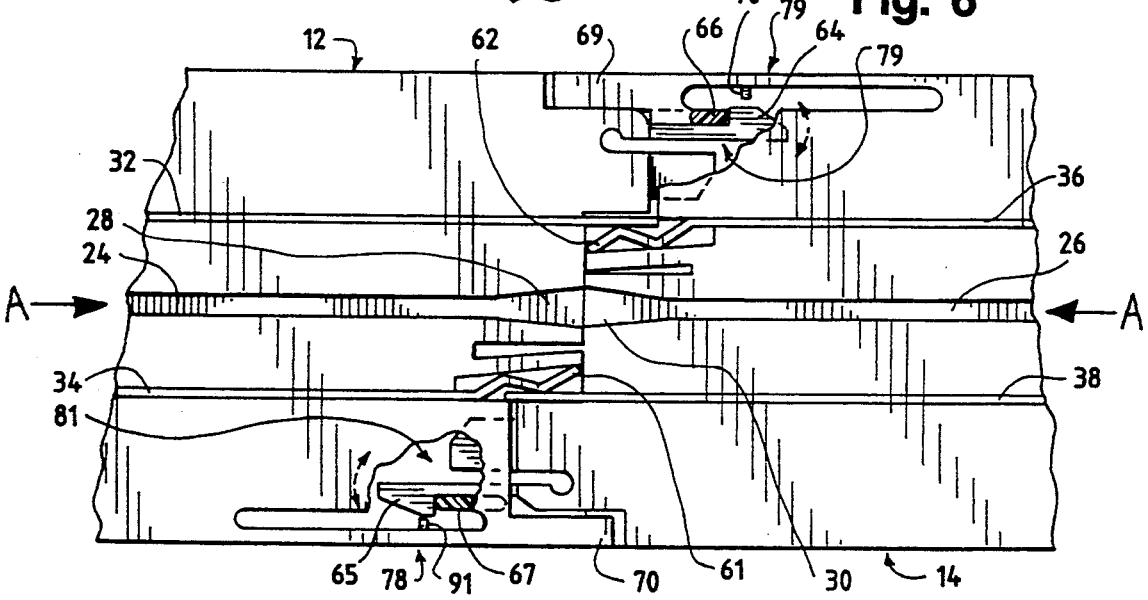
FIG. 6 is a top plan view showing the two track sections of FIG. 5.
Figure 8:
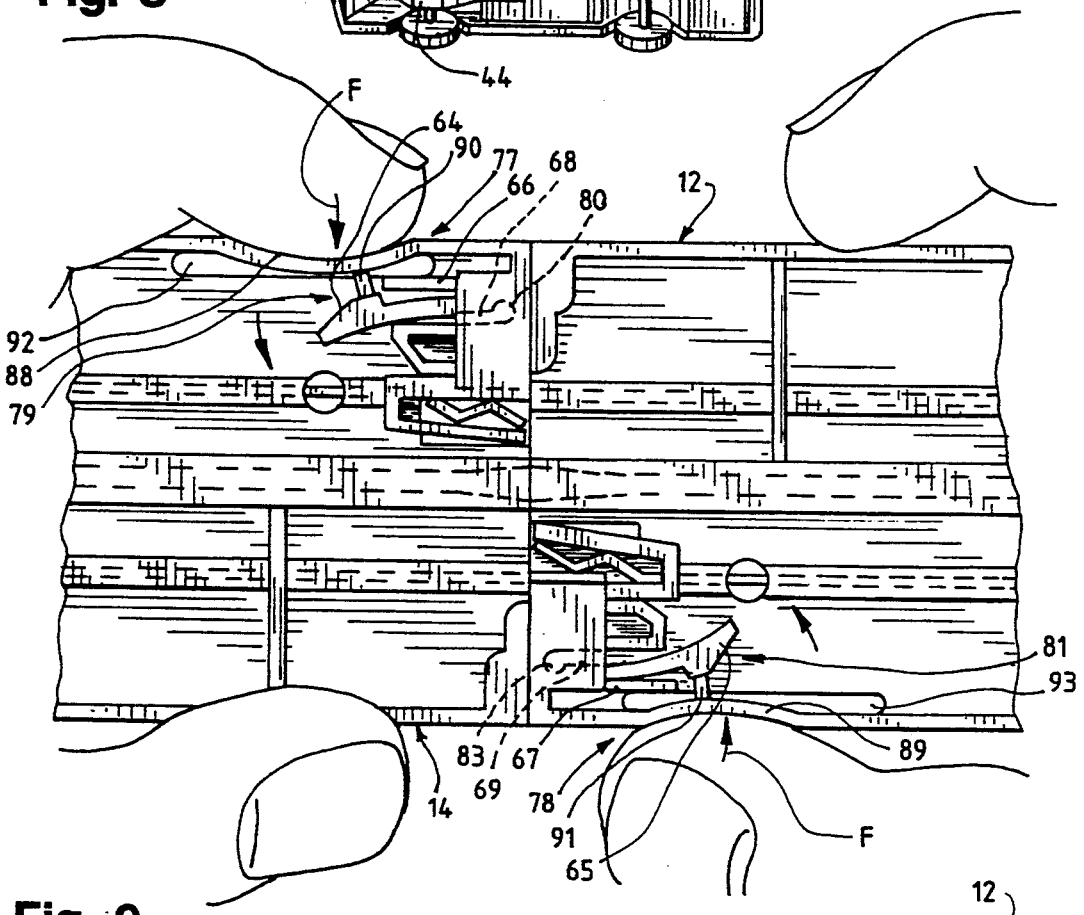
FIG. 8 is a bottom plan view of the two track sections showing the action of the releasing mechanisms.
Figure 9:
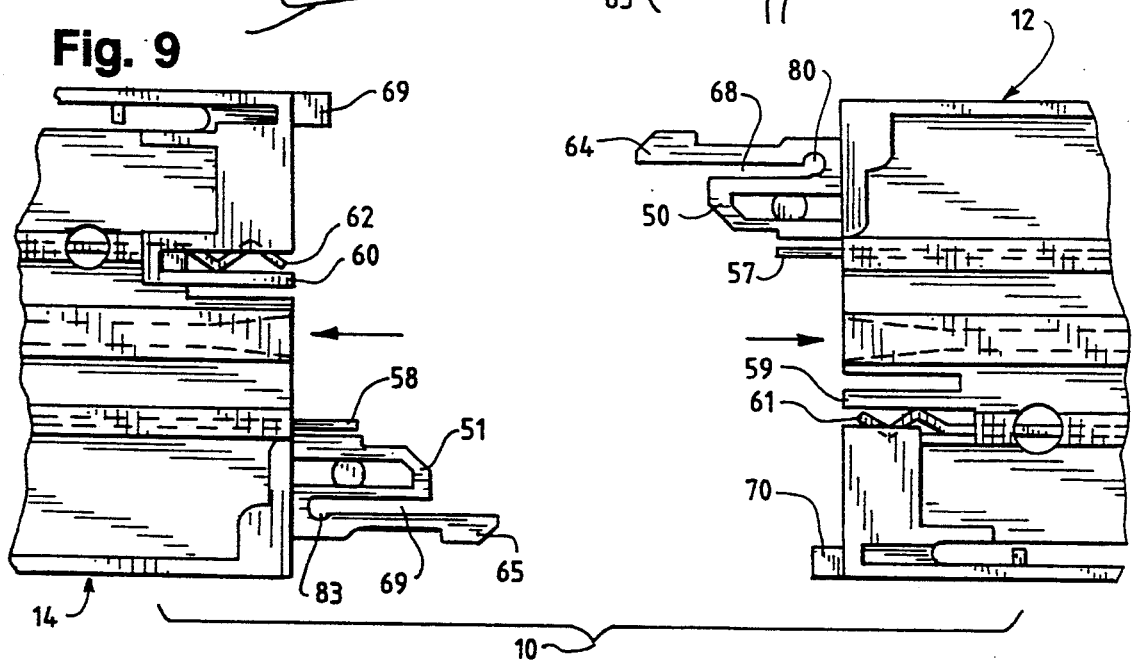
FIG. 9 is a bottom plan view showing the two track sections of FIG. 8 separated.

As shown in FIGS. 6 and 8, quick and simple release mechanisms 77 and 78 for uncoupling track sections 12, 14 after play has terminated, are positioned laterally adjacent to each coupling channel 54, 56. To disengage track sections 12, 14, a force F must be applied to the releasing mechanism 77, 78 as shown in FIG. 8. The flexible movement of release surfaces 88, 89 is achieved by their relatively long and thin construction along with placement adjacent to cutout sections 92, 93. Attached to inner release surfaces 88, 89 are release pins 90, 91 that contact hooks 64, 65 to medially displace hooks 64, 65 from their locked position against keepers 66, 67 of latching mechanism 79, 81. The bending forces applied to hooks 64, 65 are concentrated at their base by notch sections 80, 83 and open channels 68, 69. Once hooks 64, 65 are disengaged from keepers 66, 67, track section 12 is easily disengaged from track section 14 by pulling sections 12 and 14 in opposite directions, as shown in FIG. 9.

The inventive coupling mechanism, therefore, improves on the previous slot track shown in FIGS. 1 and 2 by creating separate latching and releasing mechanisms that operate horizontally to the plane of the track surface. The separate latching mechanisms 79, 81 and their corresponding releasing mechanisms 77, 78, are physically distinct structures that cooperate when the user activates the releasing mechanisms 77, 78 to displace the hooks 64, 65 from their keepers 66, 67.

Also, projecting hook 64 is spaced from its corresponding partner, hook 65, by the full width of the track, thereby concentrating the latching forces on the track edges, as opposed to the track center in the prior art system. In addition, hooks 64, 65 are incorporated into coupling channels 54, 56, thereby increasing their effectiveness in guiding and stabilizing track sections 12, 14 during assembly. Hooks 64, 65 are also rotated 90 degrees from the prior art design so that they face the lateral edges of the track, and thereby operate horizontally to the plane of the track surface rather than vertically as in the prior art system. This horizontal action allows release mechanisms 77, 78 to be positioned along the track's lateral edge, thus preventing track surface deformation through continued use of the releasing mechanisms 77, 78. Further, positioning the latching mechanisms 79, 81 and releasing mechanisms 77, 78 on the lateral edges of the track sections 12, 14 allows for more natural hand movements and pressures when separating track sections 12, 14 from each other.

Because latching mechanisms 79, 81 of the present invention laterally flank the pairs of conductive strips 32, 36 and 34, 38, coupling mechanism 10 can be easily used on single lane tracks, whereas the prior art design with its centrally located hooks 3, 4, would be difficult to use with a single-lane track configuration.

Figure 7:
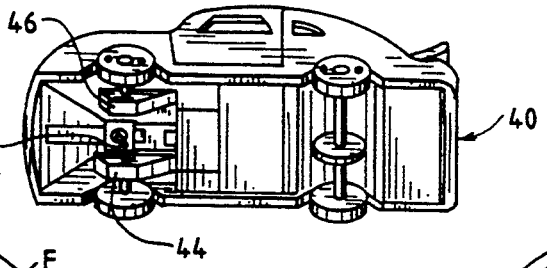
FIG. 7 is a perspective view of the underside of a toy that may be raced over the track sections of FIGS. 3–6.

As shown in FIG. 3, electric power for operation of the toy vehicle is transmitted through mating pairs of electrically conductive strips 32, 36 and 34, 38. These pairs of conductive strips are embedded in the surface of the plastic track, and run essentially parallel to the length of track sections 12, 14. The mechanical steering for the toy vehicle 40, as shown in FIG. 7, along track sections 12, 14 is provided by guidance slots 24 and 26 molded from the surface of the track, as shown in FIG. 3. The guidance slots 24, 26 run centrally between and generally parallel to the conductive strip pairs 32, 36 and 34, 38.

The toy vehicle 40, shown in FIG. 7, is placed on the assembled track sections 12, 14 in anticipation of play such that the depending vehicle pin 42 fits into guidance slots 24, 26. A pair of electrically conductive shoes 44 and 46 will then make contact with the mated pairs of conductive strips 32, 36 and 34, 38. In this way, the assembled toy track sections 12 and 14 provide electrical power through conductive strip pairs 32, 36 and 34, 38 to paired vehicle contact shoes 44, 46 to supply the toy vehicle motor with the energy necessary to propel the toy vehicle 40 along the assembled track.

To direct the toy vehicle 40 along the assembled track sections 12, 14 and to assist in maintaining electrical contact between the vehicle conducting shoes 44, 46 and the mated pairs of conductive strips 32, 36 and 34, 38, the guidance slots 24 and 26 laterally restrict the movement of the depending vehicle guide pin 42. The confronting ends 28 and 30 of slots 24 and 26 are beveled to allow for smooth communication of the depending vehicle guide pin 42 from one track section to the next. Thus, the toy vehicle's 40 movement along the track is essentially restricted to following the path formed by the communicating guidance slots 24, 26.

In assembly, initial alignment of track sections 12, 14 is provided by coupling channels 54, 56 including projection pins 50, 51 and adjacent hooks 64, 65 that fit snugly into confronting receptacles 52, 53 in the opposing track section as shown in FIGS. 3–6. These interconnecting male and female portions initiate vertical alignment of opposing track sections 12 and 14 as contact is made between hooks 64, 65 and receptacles 52, 53. Upon further insertion of hooks 64, 65 into receptacles 52, 53, projection pins 50, 51 come into contact with receptacles 52, 53, firmly establishing both vertical and horizontal alignment. Any remaining longitudinal play is substantially reduced by the resulting tight fit between projection pins 50, 51, adjacent hooks 64, 65 and confronting receptacles 52, 53.

Further longitudinal entry is blocked by the action of receptacle walls 75, 76 on body abutments 73, 74 of projection pins 50, 51. Track section 14 must be laterally displaced with respect to track section 12 for further mating of coupling channels 54, 56. This movement medially displaces hooks 64, 65 against projection pins 50, 51 in anticipation of engagement with keepers 66, 67.

As longitudinal progress continues, angular terminal connectors 61, 62 of conductive strips 34, 36 establish contact with straight terminal connectors 57, 58 of conductive strips 32, 38, as shown in FIGS. 3–6. Contact pressure between angular terminal connectors 61, 62 and straight terminal connectors 57, 58 is maintained through lateral pressure by adjacent members 59, 60 and abutment supports 73, 74. Any formed oxides that would impede electrical conductivity are removed from the surface of terminal ends 57, 58 and 61, 62 as they scrape each other's surface while track sections 12, 14 are repeatedly engaged and disengaged. Final vertical alignment is achieved as side projections 69, 70 engage side receptacles 71, 72, as shown in FIGS. 3–6. Track sections 12, 14 are now positively coupled supplying both mechanical and electrical continuity for proper operation of the toy track system.

While particular embodiments of the invention have been shown and described, it will be obvious to those skilled in the art that various changes and modifications may be made therein without departing from the spirit and scope of the invention and therefore, it is intended in the appended claims to cover all such changes and modifications that fall within the true spirit and scope of the invention.

We claim:

1. An interlocking toy vehicle track comprising adjacent track sections having opposing ends and opposing sides, each of the track sections having:

a coupling mechanism at the ends of the track section for coupling adjacent track sections to each other, the coupling mechanism comprising a male locking portion and a female locking portion, the male locking portion having a body abutment extending outwardly from the opposing ends of the track section, and an elongated, resilient hook member extending outwardly from the body abutment;

the sides of the track sections having flexible portions, the flexible portions of one track section being located adjacent to the hook members of the adjacent track sections and operatively associated with the hook members when the adjacent track sections are interlocked.

2. The interlocking toy vehicle track of claim 1 wherein the flexible portions of the sides of the track sections further include release pins on inner surfaces of the flexible portions, the release pins disposed between the flexible portions of the track section and the hook members of the adjacent track sections.

3. The interlocking toy vehicle track of claim 1, wherein the track sections include projection pins extending outwardly from the body abutments and laterally adjacent to the elongated hook members to limit lateral flexion of the elongated hook member.

4. The interlocking toy vehicle track of claim 3, wherein the track sections include side projections located at the sides of the track sections, the side projections extending outwardly from the opposing ends of the track section.

5. The interlocking toy vehicle track of claim 4, wherein said female locking portion of said coupling mechanism comprises:

a) a notch recessed inwardly from the ends of the track section adapted to receive the hook member and the projection pin of the adjacent sections; and b) a side receptacle located at the sides of the track section adapted to receive the side projection of the adjacent track sections.

6. The interlocking toy vehicle track of claim 5, wherein the coupling mechanism includes keepers located adjacent the notch, the keepers-having distal edges against which the hook members of adjacent track sections lock.

* * * * *